United States Patent [19]

Hass

[11] 4,119,178

[45] Oct. 10, 1978

[54] INTERNAL COMBUSTION ENGINE WITH DRY SUMP LUBRICATION

[75] Inventor: Jürgen Hass, Weinstadt, Germany

[73] Assignee: Daimler-Benz Aktiengesellschaft, Germany

[21] Appl. No.: 739,044

[22] Filed: Nov. 5, 1976

[30] Foreign Application Priority Data

Nov. 8, 1975 [DE] Fed. Rep. of Germany ..... 2550315

[51] Int. Cl.[2] ..... F16N 33/00

[52] U.S. Cl. ..... 184/1.5

[58] Field of Search ..... 123/196 LP, 196 S; 184/6.4, 6.13, 1.5, 106

[56] References Cited

U.S. PATENT DOCUMENTS

| | | | |
|---|---|---|---|
| 1,788,605 | 1/1931 | Walters | 184/106 |
| 1,799,271 | 4/1931 | Woolson | 184/6.13 |
| 1,966,837 | 7/1934 | Uhl | 184/6.13 |
| 2,182,948 | 12/1939 | Schjolin | 184/6.13 |
| 3,908,797 | 9/1975 | Schnepp | 184/1.5 |

*Primary Examiner*—Charles J. Myhre
*Assistant Examiner*—David D. Reynolds
*Attorney, Agent, or Firm*—Craig & Antonelli

[57] ABSTRACT

An internal combustion engine with a dry sump lubrication, in which for purposes of emptying the separate oil reservoir tank and the oil sump, a common oil discharge bolt is provided, and in which the line coming from the oil reservoir tank terminates in the bore for the oil discharge bolt ahead of the thread for the oil discharge bolt—as viewed from the outside—provided in the bore leading to the oil sump; the thread for the oil discharge bolt is thereby covered off on the side facing the engine oil sump by an oil seal formed by collected spray oil.

1 Claim, 1 Drawing Figure

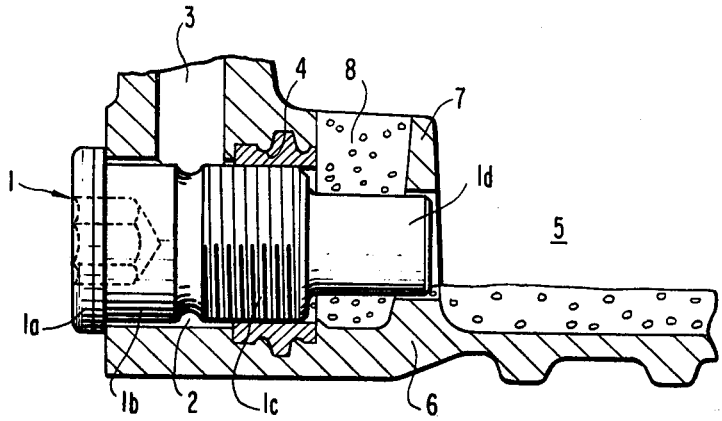
3
4
8
7
1
1d
5
1a
1b
2
1c
6

INTERNAL COMBUSTION ENGINE WITH DRY SUMP LUBRICATION

The present invention relates to an internal combustion engine with a dry sump lubrication, in which a common oil discharge bolt is provided for the emptying of the separate oil reservoir tank and of the oil sump or pan, and in which the line coming from the oil reservoir tank terminates in the bore ahead of thread for the oil discharge bolt—as viewed from the outside—which thread is provided in the bore leading to the oil sump.

With such an arrangement, it may happen, when the thread is not quite tight, that the oil pump sucks in air out of the oil sump, which leads to disturbances and failures in the lubrication of the engine and may therefore lead to serious damages in the engine.

The present invention is therefore concerned with the task to eliminate this danger and to assure with simplest possible means that also in case of a non-tightness in the thread of the oil discharge bolt, a drawing-in of air cannot occur.

The underlying problems are solved in accordance with the present invention in that the thread for the oil discharge bolt is covered off on the side facing the oil space of the oil sump of the engine by an oil seal which is formed by collected splash oil.

According to a preferred embodiment of the present invention, this oil seal is created in that the oil discharge bolt is provided adjoining its threaded portion with an extension, and in that an oil pocket which is open in the upward direction and extends below and above the thread, is formed between the oil space of the engine oil sump and the threaded area by a baffle plate, through which extends the bore, whereby the extension of the oil discharge bolt at least partially extends through the bore inside of the baffle wall and seals the same.

Accordingly, it is an object of the present invention to provide an internal combustion engine with a dry sump lubrication which avoids by simple means the aforementioned shortcomings and drawbacks encountered in the prior art.

Another object of the present invention resides in an internal combustion engine with a dry sump lubrication in which serious damage in the engine due to failure in the lubrication system of the engine is avoided by simple means.

Still a further object of the present invention resides in an internal combustion engine with a dry sump lubrication, in which the possibility of sucking-in air out of the oil sump by the oil pump in case of leakage at the oil discharge bolt is avoided by simple means.

Still another object of the present invention resides in an internal combustion engine with dry sump lubrication, in which also in case of a non-tightness in the thread of the oil discharge bolt, a sucking-in of air is made effectively impossible by structurally simple means.

These and other objects, features and advantages of the present invention will become more apparent from the following description when taken in connection with the accompanying drawing which shows, for purposes of illustration only, one embodiment in accordance with the present invention, and wherein:

The single FIGURE is a partial cross-sectional view through the area of an internal combustion engine in accordance with the present invention which includes the oil discharge and the oil discharge bolt.

Referring now to the single FIGURE of the drawing, reference numeral 1 generally designates in this FIGURE the oil discharge bolt which is arranged within the lower area of the internal combustion engine (not shown in detail). The oil discharge bolt 1 has different successive areas, and more particularly following the head 1*a*, an area 1*b* without thread, then a threaded area 1*c* and finally a pin-shaped extension 1*d*. A channel 3 which serves for the discharge of the oil out of the oil reservoir tank (not shown) that is separate from the internal combustion engine terminates in the bore 2, into which the oil discharge bolt 1 is inserted, between the areas 1*b* and 1*c*; the channel 3 is also in communication with a suction line leading from the tank into the engine, into which is interconnected a pump (not shown). In order to avoid that in case of a non-tightness or leakage in the thread 4, air is sucked by this pump out of the oil space 5 of the oil pan or sump 6 into the channel 3, an oil seal is provided for sealing off the thread 4. A baffle plate 7 serves the purpose of forming this oil seal, which projects beyond the thread 4 in the upward direction, and through which extends the bore 2, whereby the extendion 1*d* of the oil discharge bolt 1 serves the purpose of sealing off the thus-formed oil pocket 8 with respect to the oil space 5 of the oil sump 6. The oil pocket 8 which with a running internal combustion engine is supplied sufficiently with oil spray, is thereby so constructed that oil from the oil spray collecting therein seals the thread 4 completely with respect to the channel 3.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. An internal combustion engine with a dry-sump lubrication, which comprises a common oil discharge bolt means for emptying a separate oil reservoir tank and an engine oil sump, and in which a line coming from the oil reservoir tank terminates in a bore for receiving the oil discharge bolt means ahead of a thread provided in the bore, as viewed from the outside, the bore leading to the engine oil sump, characterized in that a threaded portion for the oil discharge bolt means is sealed off on a side facing an oil space of the engine oil sump by an oil seal means involving oil collected from an oil spray, the oil discharge bolt means includes an extension following the threaded portion thereof, in that the oil seal means includes an oil pocket means, open in an upward direction and extending below and above the threaded portion, formed between the oil space of the engine oil sump and the threaded portion of the oil discharge bolt means by a baffle wall means, and in that the bore continues through the baffle wall means and the extension of the oil discharge bolt means passes at least partially through said bore inside the baffle wall and seals the same.

* * * * *